United States Patent [19]

Ziegler

[11] 4,161,871

[45] Jul. 24, 1979

[54] LOCKING MECHANISM

[76] Inventor: Kurt Ziegler, Park West Villa #77, 11244 SW. 169th St., Miami, Fla. 33157

[21] Appl. No.: 925,047

[22] Filed: Jul. 17, 1978

[51] Int. Cl.[2] ..... E05B 17/14; E05B 19/06; E05B 27/04

[52] U.S. Cl. ..... 70/356; 70/362; 70/364 A; 70/409; 70/423

[58] Field of Search ..... 70/356, 357, 362, 364 A, 70/376, 409, 419, 423, 424, 427, 428

[56] References Cited

U.S. PATENT DOCUMENTS

| | | | |
|---|---|---|---|
| 1,477,318 | 12/1923 | Crass | 70/409 |
| 1,766,784 | 6/1930 | Gregory | 70/409 |
| 3,802,230 | 4/1974 | Tickett | 70/409 |

FOREIGN PATENT DOCUMENTS

| | | | |
|---|---|---|---|
| 595834 | 4/1934 | Fed. Rep. of Germany | 70/409 |
| 2343878 | 10/1977 | France | 70/419 |

*Primary Examiner*—Robert L. Wolfe
*Attorney, Agent, or Firm*—Robert J. Van Der Wall

[57] ABSTRACT

A locking mechanism is provided having a rotatable inner cylinder concentric with a fixed conventionally sized outer cylinder and coplanar resiliently urged coplanar pins. A face plate contains a nonrotatable slot to accept a substantially conventionally sized key at a 90 degree angle from the plane of the pins. The key is provided with grooves cut on a forward bias to depress the pins as the key and inner cylinder together are rotated through the plane of the pins. The inner cylinder is connected to bolt actuating linkage in the customary manner. A pin bar having reverse bias grooves in the same profile as the key is inserted into radial channels provided therefor during assembly of the lock, said pin bar permitting locking without the presence of the key. The key slot may contain a barrier bisecting the key slot to prevent unauthorized access to the pins, with a correspondence cleft in the key to fit around the barrier.

22 Claims, 10 Drawing Figures

LOCKING MECHANISM

FIELD OF THE INVENTION

This invention relates to the field of locks and, in particular, to locking mechanisms containing a plurality of resiliently urged pins which are retracted to a point appropriate for the turning of a cylinder by a key having a plurality of teeth with random elevation from the axis of rotation of the key.

BACKGROUND OF THE INVENTION

Ever since the centuries old inventions of locks, there have been efforts to defeat locks. These methods have included skeleton keys and picking of locks. Skeleton keys were particularly notorious with the old type of keys such as those illustrated in the 1859 patent to Schroeder, U.S. Pat. No. 24,523, and in Schmid, U.S. Pat. No. 1,819,059. In fact, both such patents were directed to means of blocking the key hole to prevent the use of other keys, such as skeleton keys.

This concept was continued into the lock art upon the development of keys having plurality of teeth with random variation in their elevation from the rotation axis of the key. Examples include the 1869 patent by Shepardson, U.S. Pat. No. 87,714, Heiden, U.S. Pat. No. 1,713,602, and Reisner, U.S. Pat. No. 3,475,934. Other art known as to Applicant include Keil, U.S. Pat. No. 1,867,361, Mason, U.S. Pat. No. 2,561,029, and Eichenauer, U.S. Pat. No. 1,956,438. Much of the problem with conventional locks has been that they are susceptible to being picked, even if they are somehwat more resistant to skeleton keys. It is fairly well recognized that most conventional house and automotive locks can be picked by a skilled thief in a matter of minutes. In fact, the number of issued patents directed to locking key holes since the invention of modern locks suggests to Applicant a tacit admission that present lock designs are inadequate and subject to significant improvement without significant cost increase or consumer inconvenience. One area of particular concern is that the resiliently urged pins in most present locks are in alignment with the slot into which the key is inserted, thereby exposing same to manipulation by a thief. Some locks are manufactured with two sets of pins, the ends of all of which must meet at the junction of inner and outer cylinders in order for the lock to be opened, but such a lock is still subject to manipulation by a thief, particularly if inner and outer cylinders are not in very close fitting relationship, because the pins are still in alignment with the key slot. Moreover, this type of construction is expensive, particularly if inner and outer cylinders are machined to tight tolerances for close fitting relationship. This latter design is not known by Applicant to be patented, but is in widespread use in better locks.

There is no locking mechanism known to the Applicant wherein such pins are shielded from access by the mechanism of the lock. Indeed, the foregoing references and description represent the totality of the art in this field known to the Applicant.

SUMMARY OF THE INVENTION

With the foregoing in mind, it is a principal object of the present invention to provide a locking mechanism for use within locks which shields resiliently urged pins from external access when the key is removed from the locking mechanism.

Another object of the invention is to provide a locking mechanism which shields resiliently urged pins from external access utilizing an inner cylinder suitable for use within existing locks and outer cylinders.

A related object of the invention is to increase the security of a lock by providing a locking mechanism which can be utilized with pre-existing locks to minimize the manufacturing expense and assure acceptability of increased security by the lock industry and the consumer.

Another object of the invention is to provide improved security in a lock utilizing a key of substantially conventional size for industry and consumer acceptance and for minimal changeover cost.

A further object of the invention is to utilize conventional tooling and assembly techniques for the pin box, outer cylinder, bolt, bolt movement linkage and other characteristics.

An additional object of the invention is to provide a locking mechanism having improved security and other foregoing advantages with a design suitable for mass production techniques and having only single elements which can be inserted readily into the inner cylinder during assembly and which are machined to suit the key and pin configuration.

Another object of the invention is to provide a locking mechanism which may include at least one fixed pin which will serve to prevent access to the retractable pins.

A further object of the invention is to provide a locking mechanism having a slot which is accessible only when it is at one of two favored disorientation angles to the pins, i.e. 90 degrees either side thereto.

A related object of the invention is to provide a locking mechanism which has a barrier about which a slit or cleft in the key fits, said barrier itself being accessible only when the inner cylinder and slot thereto is in a favored disorientation angle with the pins.

One more object of the invention is to provide a locking mechanism having a fixed face with a slot in favored angular disorientation to the pins, said slot thereby providing additional security from tampering with the lock's pins.

An additional object of the invention is to provide a lock which eliminates the need and expense of a second set of pins in the inner cylinder while providing improved security over conventional locks having a single set of pins.

A further object of the invention is to provide a locking mechanism having suitability for automotive, marine, aviation and other applications as well as residential use.

Other objects and advantages will become apparent to those skilled in the art upon reading the following descriptions of the invention and upon reference to the drawings.

In accordance with the invention there is provided a locking mechanism having an inner cylinder with a diameter substantially similar to those in conventional lock use, said inner cylinder including a recess in the circumference thereof substantially permitting 180 degrees of rotation with respect to the pins situated in an outer cylinder. The outer cylinder may be of conventional design including a plurality of coplanar pins of random length resiliently urged toward the center of both cylinders. The outer cylinder may also include at least one fixed pin having no resilient urging means.

The invention further comprises a pin bar with a plurality of teeth and grooves machined with a reverse oblique bias having the same pattern of random variations in height as provided the key teeth and grooves. Said pin bar includes a base fabricated for close fitting relationship with radial channels provided therefor in the inner cylinder adjacent to the key slot and into which channels the pin bar may be inserted during assembly of the lock. The invention also includes a barrier substantially bisecting the key slot of the inner cylinder positioned to coincide with a corresponding cleft in the key blank. Said barrier is for the purpose of preventing access to the pins when the rotatable key slot is coplanar with the pins. The invention further optionally comprises means cooperating between inner and outer cylinders for the purpose of retaining said inner cylinder in either limit of its arc of rotation except when moved by a key. Said means may include a ball in loose fitting internal relationship within a radial bore provided therefor, said ball centrifugally urged by resilient means also within said bore. The ball would be urged into recesses located on the inner circumference of the outer cylinder at position coincident with the extremes of the arc of rotation of the inner cylinder, which may be 180 degrees.

Finally, the invention includes a key of substantially conventional size but having a cleft therein for the length of the shank thereof and corresponding to the position and size of the barrier in the key slot of the inner cylinder. Said key shank further includes biased teeth cut obliquely to the plane of the key. Said biased teeth act as an inclined plane to lift or retract the pins when the inner cylinder with key inserted is rotated to bring said biased teeth into contact with the pins. In this manner, the pins are raised to the proper position for opening the lock not by the insertion of the key into the keyhole as in a conventional lock, but rather by rotation of the biased teeth against the pins as the inner cylinder and key rotate. The pin bar, earlier described adjacent to the key slot receives the pins in grooves as the key is rotated past the position of the pins. As the inner cylinder is rotated toward the limit of rotation with the lock in the open position, the pins are then permitted to extend to their extreme. When the inner cylinder is rotated back, the pins bar also acts as an inclined plane using its oblique grooves to raise the pins to the proper position corresponding to the height of each tooth on the key, and the inner cylinder may then be rotated to its extreme rotation in the locked position, and the key withdrawn if desired.

The invention will be better understood after reading the following detailed description of the embodiments thereof with reference to the appended drawings, in which:

DETAILED DESCRIPTION

Figure 1:
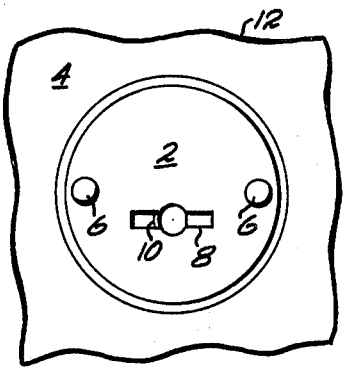
FIG. 1 is a front elevation of the invention showing the horizontal key slot with bisecting barrier therein.

Referring now to FIG. 1, a fixed face plate 2 is shown mounted on an object being locked 4 with fastening means 6. A key slot 8 is shown in the fixed face plate 2 through which can be seen the inner cylinder key slot bisecting barrier 10 and the base of the inner cylinder key slot 12.

Figure 2:
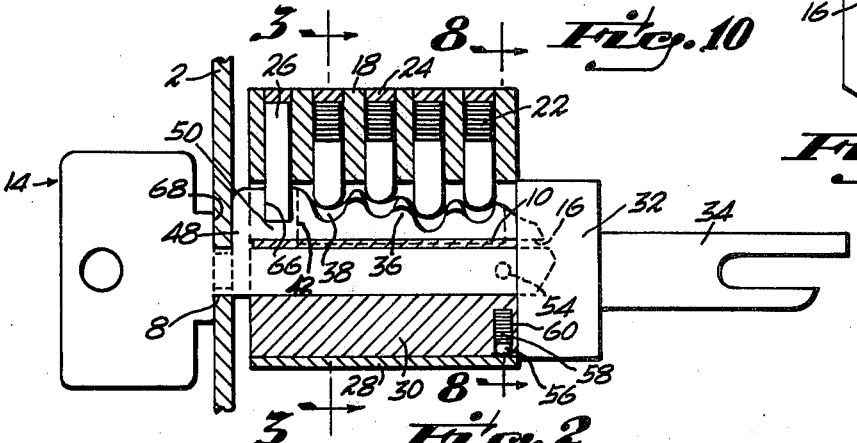
FIG. 2 is a cross-sectional slightly enlarged side elevation of the invention showing the key and inner cylinder in a vertical position one half way through their operational arc.

In FIG. 2, a key 14 is shown in vertical position in the inventive locking mechanism penetrating the fixed face plate 2 through the key slot 8 and around the barrier 10. The key has a cleft 16 to fit around the barrier 10. The lock includes a conventional pin box 18 having a plurality of movable pins 20 of random length, but with a predetermined pattern, in contact with resilient urging means 22 and held in place with caps 24. At least one fixed pin 26 may also be included. Such fixed pins lack resilient urging means 22. The pin box is part of and connected to an outer cylinder 28 inside of which is rotatably positioned inner cylinder 30. Inner cylinder 30 may optionally have spool ends (not shown) to maintain its concentric relationship with the axis of outer cylinder 28. Outer cylinder 28 and pin box 18 may be of conventional size and shape to fit within locks presently manufactured. In the same manner, rear of the lock 32 and actuating yoke 34 may be of conventional size and design.

FIGS. 1 and 2 show the fixed face plate key slot at a 90 degree angle from the pins, but any other angular disorientation from the plane of the pins is both permissible and contemplated within the scope of this invention. Moreover, the key slot in the face plate is shown horizontal and the pins vertical, but in new locks the invention can of course be rotated 90 degrees so that a conventional vertical key slot is presented to the consumer.

Figure 3:
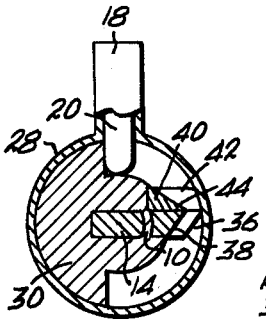
FIG. 3 is an axial cross-section taken along the line 3—3 of FIG. 2 and having the key and inner cylinder rotated to the limit of their rotatinal arc with the lock open.

Turning now to FIG. 3, there is illustrated outer cylinder 28 containing inner cylinder 30, fully extended movable pin 20 retained by pin box 18, barrier 10 around which is closely fit key 14. The key 14 has biased (obliquely cut) teeth 36 and grooves 38 which act as an inclined plane when they come in contact with the pins 20 as shown in other views. The pin bar 40 is inserted during assembly of the lock in a channel 42 provided therefor in the inner cylinder, and has obliquely cut grooves 44 with a reverse bias to those of the key 14. The lock is shown in FIG. 3 in its fully open position, but with the key inserted into the lock.

Figure 4:
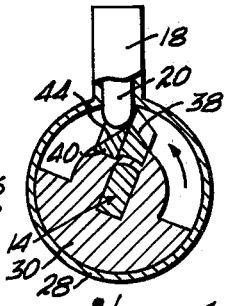
FIG. 4 is another axial cross-section taken at the same point as FIG. 3 and showing the key and inner cylinder rotating to the point where the pin bar is raising the pins as the apparatus is locked.

In FIG. 4, movement of the inner cylinder is shown as the apparatus is in the process of being locked. Pin 20 is shown being retracted into pin box 18 by the inclined plane surface 44 of pin bar 40. This is so the pin 20 rises to a height coincident with the height of the key groove 38 which is obliquely cut in an inclined plane but with the opposite angle from the reverse bias of the pin bar 40.

Figure 5:
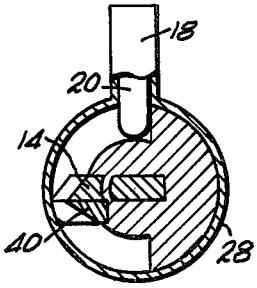
FIG. 5 is another axial cross-section at the same point showing the key and inner cylinder rotated to the limit of their rotational arc with the apparatus in a locked configuration.

In FIG. 5, pin 20 has again extended from pin box 18 to its limit since inner cylinder 40 has been rotated within outer cylinder 28 beyond the surfaces of key 14 and pin bar 40. FIG. 5 discloses the fully locked position of the apparatus, but with the key still in the lock. At this point, it is in planar orientation with the key slot 8, shown only in FIG. 1 and FIG. 2. In this orientation, the key could be removed. The only other orientation from which the key can be removed is that shown in FIG. 3, the fully opened position.

Figure 6:
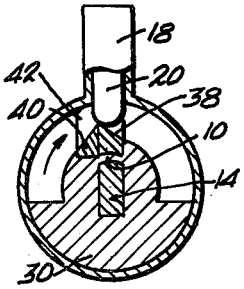
FIG. 6 is a further such axial cross-section taken along the line 3—3 and showing the key and inner cylinder in the position of FIG. 2, opening the lock.

FIG. 6 shows, in axial cross-section, the position of the apparatus shown in FIG. 2 and is taken along the line 3—3 of FIG. 2. The lock is in the process of being opened as pin 20 is retracted into pin box 18 by the biased surface of groove 48 on key 14. Pin bar 40 is also shown inserted into channel 42.

Figure 7:
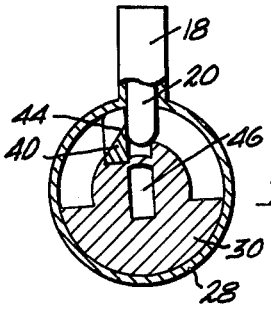
FIG. 7 is a final such axial cross-section with the key removed showing the inaccessability of the pins by reason of the barrier.

Turning now to FIG. 7, the security of the present invention is clearly illustrated. It is assumed that a thief has managed to rotate the inner cylinder 30 within outer cylinder 28 without the benefit of a key. Therefore, FIG. 7 shows a void at 46 where the key would normally be located. Pin 20 remains fully extended from pin box 18 and cannot pass pin bar 40 because of the absence of the inclined plane in the grooves of the absent key. To be noted is that there is no access at all in this view from void 46 to pin 20 because of barrier 10. In fact, returning momentarily to FIG. 2, access to pins 20 can only be had by making three right angle turns through the mechanism in a manner that would prohibit picking the lock in the conventional manner. Access is only through keyhole 8, followed by a right angle turn through an opening 48 between fixed face plate 2 and the end of barrier 10, followed by a second right angle turn through an opening 50 between fixed pin 26 and barrier 10, followed by a third angular turn to pins 20.

Although not shown in the drawings, the pins 20 could be made all the same length, and pin bar 44 recessed somewhat from void 46 in FIG. 7, above the barrier 10. These minor changes would frustrate the practice of some thieves of inserting into the lock a key blank having a wax or other pressure sensitive coating and taking an impression of the pin length profile, or of the pin bar profile.

Figure 8:
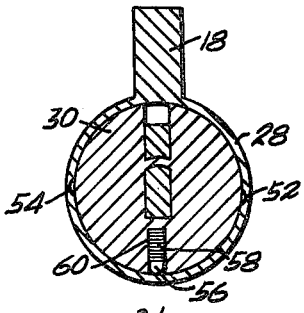
FIG. 8 is an axial cross-section taken along the line 8—8 of FIG. 2 and showing means cooperating between inner and outer cylinders for the purpose of retaining the inner cylinder in either limit of its 180 degree arc of rotation, except when moved with a key.

In order to further deter access to the pins by rotation of inner cylinder 30 within outer cylinder 28 without the key present, as shown in FIG. 7, means cooperating between inner and outer cylinders may optionally be provided as shown in FIG. 8. In FIG. 8, outer cylinder 28 has two detents 52 and 54 to coincide with the limits of rotation of inner cylinder 30. FIG. 8 is taken along line 8—8 of FIG. 2. A ball 56 of the same approximate diameter as detents 52 and 54 is resiliently urged by means 58 from behind. Means 58 and ball 56 are contained within bore 60.

Figure 9:
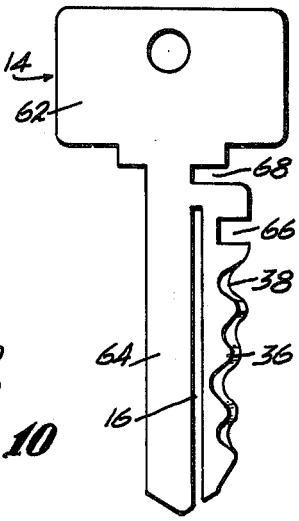
FIG. 9 shows the key of the invention in elevation emphasizing the oblique teeth and cleft therein.

Turning now to FIG. 9, key 14 comprises a head 62 and shank 64, said shank being cut by a longitudinal cleft 16 which corresponds to the barrier 10 (not shown in this view). Teeth 36 and grooves 38 all contain an inclined plane, except for groove 66 which accommodates the fixed pin 26. Cut 68 permits the key to rotate within fixed plate 2.

Figure 10:
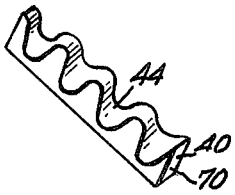
FIG. 10 shows a perspective view of the pin bar with the random height of its oblique groove corresponding to the height of the teeth on the key.

Turning finally to FIG. 10, pin bar 40 is shown with grooves 44 having an inclined plane opposite in angularity to the inclined plane of the key 14. Pin bar 40 has base 70 designed for close fitting relationship with channel 42 shown in FIG. 3. Pin bar 40 can be mass produced in the same manner as keys 14. In fact, they may be machined in the same step since achievement of the inclined plane in the opposite direction can be obtained by rotating the pin bar in a jig 90 degrees from the key 14.

Having described the presently preferred embodiments of the invention, it should be understood that various changes in construction and arrangement will be apparent to those skilled in the art and are fully contemplated here without departing from the true spirit of the invention. Accordingly, there are covered all alternatives, modifications, and equivalents as may be included within the spirit and scope of the invention as defined solely by the appended claims.

What is claimed is:

1. A locking mechanism for use with locks having an outer cylinder with pin box retaining a plurality of movable resiliently urged pins, and bolt with actuating linkage, comprising:

a face plate fixedly attached to an object sought to be locked, and having therein a fixed slot in angular disorientation to a plane of the movable resiliently urged pins;

an inner cylinder in rotationally movable internal concentric relationship to the outer cylinder, having a key slot, and having a pin bar substantially adjacent and parallel to a plane of the key slot, said pin bar having a plurality of biased grooves forming inclined planes of random height; and means connecting the inner cylinder to the bolt actuating linkage.

2. The locking mechanism of claim 1, wherein the key slot is further comprised of a barrier longitudinally bisecting said key slot.

3. The locking mechanism of claim 1, which further comprises a key with head connecting shank, longitudinal cleft in the shank, and a plurality of biased grooves forming inclined planes on at least one edge of the shank, the direction of said bias being reverse the bias of the pin bar grooves.

4. The locking mechanism of claim 1, further comprising pin bar channels in the inner cylinder substantially adjacent to the key slot, substantially parallel to both the key slot and the face plate, and with the pin bar having a base fabricated for, and in close fitting relationship with, the pin bar channels.

5. The locking mechanism of claim 1, which further comprises at least one fixed pin having no resilient urging means.

6. The locking mechanism of claim 5, which further comprises a key with head, connecting shank, longitudinal cleft in the shank, a plurality of biased grooves forming inclined planes on at least one edge of the shank, the direction of said bias being reverse the bias of the pin bar, and at least one further groove without bias, said groove corresponding to at least one fixed pin.

7. The locking mechanism of claim 1, which further comprises means collaborating between inner and outer cylinders for the purpose of tending to retain the inner cylinder to either limit of its rotational arc.

8. The locking mechanism of claim 7, wherein the means collaborating between inner and outer cylinders comprises at least one radial bore in the inner cylinder, a hardened ball in loose fitting internal relationship within each bore, means for resiliently urging the ball centrifugally of the inner cylinder, and at least one recess for accepting less than a hemisphere of the ball, said recess located on the inner circumference of the outer cylinder in the same plane as the arc of rotation of the ball and at a position coincident with the limit of the arc of rotation of the inner cylinder.

9. A locking mechanism for use with locks having an outer cylinder with pin box retaining a plurality of movable resiliently urged pins and bolt actuating linkage, comprising:

a face plate fixedly attached to an object sought to be locked, and having therein a fixed slot in angular disorientation to a plane of the movable resiliently urged pins;

an inner cylinder in rotationally movable internal concentric relationship to the outer cylinder, having a key slot, and having a pin bar substantially adjacent and parallel to a plane of the key slot, said pin bar having a plurality of biased grooves forming inclined planes of random height, a barrier longitudinally bisecting the key slot;

a key with head, connecting shank, longitudinal cleft in the shank, and a plurality of biased grooves forming inclined planes on at least one edge of the shank, the direction of said bias being reverse the bias of the pin bar grooves; and means connecting the inner cylinder to the bolt actuating linkage.

10. The locking mechanism of claim 9, further comprising pin bar channels in the inner cylinder substantially adjacent to the key slot, substantially parallel to both the key slot and the face plate, and with the pin bar having a based fabricated for, in close fitting relationship with, the pin bar channels.

11. The locking mechanism of claim 9, which further comprises at least one fixed pin having no resilient urging means.

12. The locking mechanism of claim 11, which further comprises a key with head, connecting shank, longitudinal cleft in the shank, a plurality of biased grooves forming inclined planes on at least one edge of the shank, the direction of said bias being reverse the bias of the pin bar, and at least one further groove without bias, said groove corresponding to at least one fixed pin.

13. The locking mechanism of claim 9, which further comprises means collaborating between inner and outer cylinders for the purpose of tending to retain the inner cylinder to either limit of its rotational arc.

14. The locking mechanism of claim 13, wherein the means collaborating between inner and outer cylinders comprises at least one radial bore in the inner cylinder, a hardened ball in loose fitting internal relationship within each bore, means for resiliently urging the ball centrifugally of the inner cylinder, and at least one recess for accepting less than a hemisphere of the ball, said recess located on the inner circumference of the outer cylinder in the same plane as the arc of rotation of the ball and at a position coincident with the limit of the arc of rotation of the inner cylinder.

15. A locking mechanism comprising:

an outer cylinder;

a pin box fixedly attached to the outer cylinder;

a plurality of movable pins retained within the pin box and resiliently urged centripetally;

an inner cylinder in rotationally movable internal concentric relationship to the outer cylinder, having a key slot, and having a pin bar substantially adjacent and parallel to a plane of the key slot, said pin bar having a plurality of biased grooves forming inclined planes of random height;

a face plate fixedly attached to an object being locked, and having therein a fixed slot in angular disorientation to the plane of the movable pins; and means connecting the inner cylinder to a bolt actuating linkage.

16. The locking mechanism of claim 15, further comprising in the key slot of the inner cylinder a longitudinally bisecting barrier.

17. The locking mechanism of claim 15, further comprising pin bar channels in the inner cylinder substantially adjacent to the key slot and substantially parallel to both the key slot and the face plate and with the pin bar having a base fabricated for, and in close fitting relationship with, the pin bar channels.

18. The locking mechanism of claim 15 which further comprises a key with head, connecting shank, longitudinal cleft in the shank, and a plurality of biased grooves forming inclined planes on at least one edge of the shank, the direction of said bias being reverse the bias of the pin bar grooves.

19. The locking mechanism of claim 15 which further comprises at least one fixed pin having no resilient urging means.

20. The locking mechanism of claim 19, which further comprises a key with head, connecting shank, longitudinal cleft in the shank, a plurality of biased grooves forming inclined planes on at least one edge of the shank, the direction of said bias being reverse the bias of the pin bar, and at least one further groove without bias, said groove corresponding to at least one fixed pin.

21. The locking mechanism of claim 15, which further comprises means collaborating between inner and outer cylinders for the purpose of tending to retain the inner cylinder to either limit of its rotational arc.

22. The locking mechanism of claim 21, wherein the means collaborating between inner and outer cylinders comprises at least one radial bore in the inner cylinder, a hardened ball in loose fitting internal relationship within each bore, means for resiliently urging the ball centrifugally of the inner cylinder, and at least one recess for accepting less than a hemisphere of the ball, said recess located on the inner circumference of the outer cylinder in the same plane as the arc of rotation of the ball and at a position coincident with the limit of the arc of rotation of the inner cylinder.

* * * * *